US006573868B2

(12) United States Patent
Johnson et al.

(10) Patent No.: US 6,573,868 B2
(45) Date of Patent: Jun. 3, 2003

(54) RETRACTABLE ANTENNA FOR ELECTRONIC DEVICES

(75) Inventors: Thomas A. Johnson, Draper, UT (US); Tim Urry Price, Bountiful, UT (US)

(73) Assignee: 3Com Corporation, Santa Clara, CA (US)

( * ) Notice: Subject to any disclaimer, the term of this patent is extended or adjusted under 35 U.S.C. 154(b) by 141 days.

(21) Appl. No.: 09/795,168

(22) Filed: Feb. 28, 2001

(65) Prior Publication Data

US 2002/0118135 A1 Aug. 29, 2002

(51) Int. Cl.[7] ..... H01Q 1/24
(52) U.S. Cl. ..... 343/702; 343/901
(58) Field of Search ..... 343/702, 901, 343/903; H01Q 1/24

(56) References Cited

U.S. PATENT DOCUMENTS

| | | | | | |
|---|---|---|---|---|---|
| 2,531,215 | A | | 11/1950 | Harmon | 250/14 |
| 3,579,241 | A | | 5/1971 | Antista | 343/702 |
| 4,543,581 | A | | 9/1985 | Nemet | 343/702 |
| 4,584,709 | A | | 4/1986 | Kneisel et al. | 455/78 |
| 4,725,845 | A | * | 2/1988 | Phillips | 343/702 |
| 4,980,695 | A | | 12/1990 | Blaese | 343/715 |
| 5,138,328 | A | | 8/1992 | Zibrik et al. | 343/702 |
| 5,373,149 | A | | 12/1994 | Rasmussen | 235/492 |
| 5,440,315 | A | | 8/1995 | Wright et al. | 343/702 |
| 5,557,288 | A | | 9/1996 | Kato et al. | 343/702 |
| 5,627,550 | A | | 5/1997 | Sanad | 343/702 |
| 5,646,635 | A | | 7/1997 | Cockson et al. | 343/700 |
| 5,667,390 | A | | 9/1997 | Keng | 439/76.1 |
| 5,684,672 | A | * | 11/1997 | Karidis et al. | 343/702 |
| 5,773,332 | A | | 6/1998 | Glad | 439/344 |
| 5,859,622 | A | * | 1/1999 | Phillips | 343/702 |
| 5,918,163 | A | | 6/1999 | Rossi | 455/90 |
| 6,172,645 | B1 | | 1/2001 | Hollander et al. | 343/702 |
| 6,195,050 | B1 | * | 2/2001 | Kim | 343/700 MS |
| 6,321,099 | B1 | * | 11/2001 | Norimatsu | 343/702 |

* cited by examiner

*Primary Examiner*—Hoanganh Le
(74) *Attorney, Agent, or Firm*—Workman, Nydegger & Seeley

(57) ABSTRACT

A retractable antenna system is disclosed that enables electronic devices to engage in wireless communication. A preferred embodiment includes a retractable antenna disposed within a cavity in the electronic device and an actuating mechanism for selectively extending and retracting the antenna from within the cavity. The antenna system is preferably disposed within the housing of a communications card such as a PC Card. The retractable antenna may be rigid or flexible, and may be a single piece design or telescopic. The antenna system may also include two or more retractable antennas, a light source attached to the antenna, a control mechanism used to determine antenna functionality based on the positioning of the antenna, and the retractable antenna may be connected modular portion of the communication card.

48 Claims, 7 Drawing Sheets

RETRACTABLE ANTENNA FOR ELECTRONIC DEVICES

BACKGROUND OF THE INVENTION

1. Field of the Invention

The present invention generally relates to electronic devices that allow wireless communication. More particularly, the present invention relates to a retractable antenna that requires a very small amount of space within an electronic device.

2. Description of Related Art

Computers are often connected to various communication systems to exchange data and transmit information. In particular, computers are frequently linked by communication systems or networks such as Local Area Networks ("LANs"), Wide Area Networks ("WANs"), Internet, Ethernet and conventional telephone networks. Computers are typically attached to these communication systems by telephone lines or other specialized wiring. In some locations, however, it is difficult if not impossible to be physically connected to a communication system. Additionally, these communication systems often cannot be used if the user is traveling or moving between locations.

Electronic communications cards are frequently used to connect computers to these communication systems or networks. Conventional communications cards are often in the form of modular cards that can be plugged into a slot or receiving port in the computer. These communications cards can be easily inserted and removed for use with different computers, and the cards allow communication with different networks or systems to be established. Conventional communications cards are often constructed according to the Personal Computer Memory Card International Association ("PCMCIA") standards that define card size, also referred to as "form factor," for purposes of compatibility and wide use. Communications cards that conform to these standards are often referred to as PCMCIA or PC cards. These standards are set forth in the PC card standard, which is incorporated by reference in its entirety.

It is also known to use cellular telephones to connect computers to various communication systems and networks. Cellular telephone systems are particularly effective in allowing computers to communicate because the computers do not have to be physically connected to telephone lines or other specialized wiring. Instead, the computers are connected to the communication system by the cellular telephone network. Disadvantageously, cellular telephone systems require the use of a cellular phone, a connection to the cellular telephone network, various cables and interfaces to connect the telephone to the computer, and complicated circuitry to allow the computer and cellular phone to communicate.

Additionally, it is known to attach an antenna directly to a computer to allow wireless communication. Conventional antennas are typically placed external to the body of the computer because of noise, interference, obstruction and shielding caused by the various components of the computer. In addition, conventional antennas are generally rigid and protrude a relatively long distance from the body of the computer. These protruding antennas are often large, unwieldy, aesthetically unpleasing and they make the computer difficult to move and transport. In addition, these antennas are often bent, broken, knocked out of alignment or otherwise damaged because they can easily catch or strike objects such as people, walls, doors, etc. Further, these known antennas require a large support structure to secure the antenna to the housing of the computer and this support structure requires a considerable amount of space inside the body of the computer. This space is very valuable, especially in small, portable computers. Additionally, the support structure is often damaged when the antenna is accidentally moved or bumped.

The repair and replacement of conventional antennas is often difficult and costly because the antenna must be detached and removed from the computer. In fact, the entire antenna assembly is often removed and replaced instead of attempting to repair the antenna because the support structure is also often damaged or in need of repair. Thus, the repair of conventional antennas and the corresponding support structure is often expensive and time consuming.

In order to alleviate these problems, conventional antennas are often removed or detached from the computer before it is moved or transported. Additionally, conventional antennas must often be removed before the computer can be inserted into its carrying case. Disadvantageously, this requires additional time to remove and reattach the antenna whenever the computer is moved. Additionally, when the antenna is detached from the computer, it is often misplaced, lost, or damaged. Further, because the user often does not want to take the time and effort to remove the antenna, the computer is moved with the antenna still attached to the computer and this frequently results in the antenna being damaged or broken.

Another disadvantage of many known antenna systems is the antenna is always operable and ready for wireless communication. This may allow wireless communication when it is not desired or permitted, such as during an airline flight. Additionally, this may allow the antenna to transmit or receive signals while it is stored inside the computer, which may cause interference or otherwise disrupt the operation of the computer.

Yet another disadvantage of these known antenna systems is power is continually being drawn from the computer because the antenna system is always operating. This is a problem especially with portable or smaller-sized computers that use battery power. Because portable computers have a smaller battery with limited electrical storage capabilities, the continuous operation of the antenna system further decreases the amount of time that the computer can be used.

SUMMARY OF THE INVENTION

A need therefore exists for an antenna system that eliminates the above described disadvantages and problems.

One aspect of the present invention is an antenna system that is suitable for use with electronic devices. Preferably, the antenna system is operable with portable or relatively small sized electronic devices such as portable computers and electronic communications cards. Advantageously, because the antenna system requires only a small space, it is useful with relatively small electronic devices. In addition, because the associated support structure for the antenna has a small size and requires a relatively small space within the electronic device, it provides room for other components and structures.

Another aspect is an antenna system with a retractable antenna that is selectively moveable between an extended position and a retracted position. In the extended position, the antenna is disposed substantially outside of the housing of the electronic device and it is able to engage in wireless communication. In the retracted position, the antenna is disposed substantially within the electronic device.

Significantly, the retracted position reduces the risk of damage to the antenna during storage or transport of the electronic device. Advantageously, the antenna is easily accessible and movable, which allows the user to quickly and easily move the antenna between the extended and retracted positions. Preferably, the antenna is only operable in the extended position and not the retracted position in order to conserve power and prevent electrical interference with other components in the electronic device.

Yet another aspect is an antenna system with an antenna that can be directionally oriented as desired by the user. This freedom of movement allows the antenna to maximize its wireless transmission and reception capability. Preferably, the antenna is flexible and includes a universal or swivel joint to allow the antenna to be placed in the desired position. Additionally, the antenna may include multiple radiating elements that may be positioned in the desired locations.

Another aspect is an antenna system that may be employed in a variety of electronic devices, including portable computers, personal digital assistants ("PDAs"), cellular phones, palm devices, communications cards, compact flash cards, etc. Significantly, the relatively small size of the antenna allows it to be used in connection with a wide variety of types of electronic devices.

Still another aspect is an antenna system with a retractable pop-out antenna that is sized and configured to be attached to a thin architecture PCMCIA card ("PC card") for use in a portable computer. Advantageously, the circuitry or other components necessary for wireless communication may be located in the communications card and electrically connected to the antenna. Alternatively, some or all of the circuitry or other components necessary for wireless communications can be attached to the antenna or its support structure and this system may be connected to a PC card. Significantly, the antenna and/or antenna system can be removably attached to the PC card.

Another aspect is an antenna system with an antenna that easily extends and retracts according to the wishes of the user. For example, when it is desired to engage in wireless communication, the user depresses the exposed end of the antenna, which causes the antenna to move from the storage position to the extended position. An actuating mechanism is desirably located within the communications card that urges the antenna into the extended position. Once extended, the communications card may engage in wireless communication with any suitable systems or devices, such as LANs, Personal Area Networks ("PANs"), cellular telephone networks, digital communication systems, etc. When it is desired to store the antenna, the user simply pushes the antenna into the storage position. Preferably, the antenna is locked in place by the actuating mechanism where it remains out of the way until needed again by the user.

Still another aspect is an antenna system with a control mechanism that allows wireless communication when the antenna is in the extended position and prevents wireless communication when is the retracted position. Such a feature is desirable to prevent electromagnetic interference or other disruption of the computer when the antenna is in its stored position. Additionally, the control mechanism advantageously saves power and/or battery life of the communications card and/or portable electronic device. Moreover, the control mechanism may assist in the compliance with future Federal Aviation Administration (FAA) or Federal Communication Commission (FCC) requirements that wireless communication not be permitted in certain locations or during specific times. For example, wireless communication may not be permitted on airplanes, in hospitals, at construction sites, within high security buildings, or at other sensitive or protected areas. Thus, by simply placing the retractable antenna in the storage position, wireless communication is not permitted. The other features of the communications card and/or electronic device, however, may still be usable even though wireless communication is not possible. Thus, the user may continue to use other functions of the electronic device despite the unavailability of wireless communication. In addition, the antenna system could include a manual control switch that selectively enables operation of the antenna according to the wishes of the user. A light source also may be disposed on the tip of the antenna (or other appropriate location) to signify, for example, when the antenna is functional, or when it is transmitting or receiving information.

A further aspect is an antenna system with two or more antennas. Advantageously, the antenna system allows multiple antennas to be attached to an electronic device in a relatively small space. For example, two antennas or more may reside in a communications card, such as a PC card. This may allow wireless communication, for example, with different types or configurations of communication systems.

Another aspect is an antenna system with a retractable antenna and a media connector interface, such as an RJ series connector jack. For example, the retractable antenna and the RJ series connector jack may be disposed in a communications card, such as a PC card. Alternatively, the communications card may include a receiving portion so that either or both the retractable antenna and RJ series connector jack may be attached to the card. In particular, the retractable antenna and the RJ series connector jack may be found as a module that is attachable to the communications card. Alternatively, the retractable antenna could be disposed in a first module and the RJ series connector jack could be disposed in a second module. The first and second modules may be interchangeably or simultaneously connected to the communications card as desired by the user.

Yet another aspect is an antenna system with an antenna and/or antenna housing that is detachable from the communications card. Advantageously, the removable antenna and/or antenna housing allow the system to be easily repaired or replaced. In addition, this may allow other types of antennas or connectors to be readily connected to the electronic device.

Significantly, the antenna system is compact and it can be used in a variety of electronic devices, such as communications cards or PC cards, because of its relatively small size. The antenna system also allows wireless communication while minimizing design and manufacturing costs because of its small size. The antenna system is also versatile because of its small size and orientation capabilities, which provide maximum wireless reception and transmission capabilities.

These and other aspects, features and advantages of the present invention will become more fully apparent from the following description of preferred embodiments and appended claims.

BRIEF DESCRIPTION OF THE DRAWINGS

The appended drawings contain figures of preferred embodiments of the present invention. The drawings illustrate some of the aspects, features and advantages of the invention that will be described in greater detail below. The drawings, however, are only intended to illustrate preferred embodiments of the invention and not limit its scope. The drawings contain the following figures.

DETAILED DESCRIPTION OF THE PREFERRED EMBODIMENTS

The present invention involves an antenna system for use with an electronic device such as a communications card. The communications card is preferably used in connection with a computer, such as a portable or laptop computer, but it will be understood that the communications card may be used with any suitable type of general or special purpose computer. Additionally, the principles of the present invention are not limited to communications cards or computers and it will be understood that, in light of the present disclosure, the antenna system disclosed herein can be successfully used in connection with other types of electronic devices.

Additionally, to assist in the description of the antenna system, words such as top, bottom, front, rear, right, left, vertical and horizontal are used to describe the accompanying figures. It will be appreciated, however, that the antenna system can be located in a variety of desired positions—including sideways and even upside down. A detailed description of the antenna system now follows.

Figure 1:
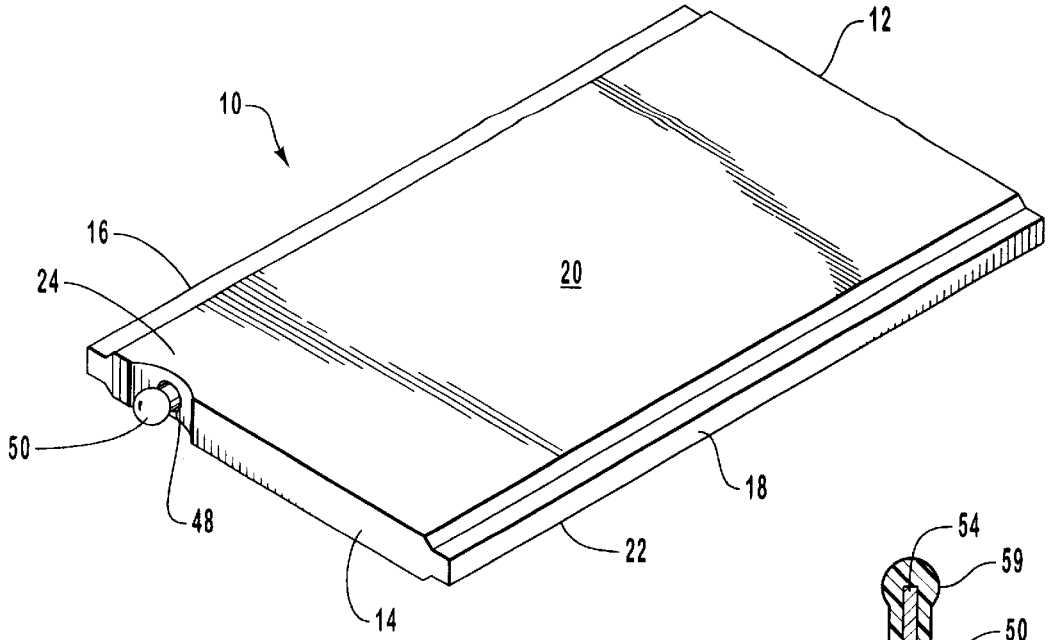
FIG. 1 is a perspective view of a communications card with a retractable antenna in accordance with a preferred embodiment of the present invention, illustrating the antenna in a retracted position.

FIG. 1 illustrates a communications card 10 with a front face 12, a rear face 14, a left side 16, a right side 18, a top 20 and a bottom 22, which form an external housing 24 of the communications card. The communications card 10 preferably complies with applicable Personal Computer Memory Card International Association (PCMCIA) standards. The PCMCIA card standards are described in detail in the PC Card Standards, which is incorporated by reference. Briefly, as known to those skilled in the art, the PC Card Standards provide physical specifications for three types of PC Cards. All three PC Card types have the same length (85.6 mm) and width (54.0 mm) and use the same 68-pin connector. The only difference between the card types is thickness. The thickness of a Type I card is 3.3 mm, a Type II card is 5.0 mm, and a Type III card is 10.5 mm. Additionally, the different card types have various features that fit the needs of the intended applications. For example, Type I PC Cards are typically used for memory devices such as RAM, Flash, OTP, and SRAM cards. Type II PC Cards are generally used for I/O devices such as data/fax modems, LANs, and mass storage devices. Type III PC Cards are used for devices whose components are thicker, such as rotating mass storage devices. It will be understood that, while the communications card 10 is generally described with respect to PCMCIA standards, the communications card can be any suitable type of card, such as compact flash cards, miniature cards, smartmedia cards, etc. Alternatively, the communications card 10 does not have to comply with any particular standards or guidelines, and it can have any suitable size or configuration.

As shown in FIG. 1, a recess or cavity 48 is located in the rear face 14 of the communications card 10 and a retractable antenna 50 is disposed within the recess. In the retracted position shown in FIG. 1, the end of the antenna 50 protrudes slightly outwardly from the rear face 14 of the communications card 10. It will be appreciated, however, that the end of the antenna 50 could also be located flush with the rear face 14 of the communications card 10 or be located inwardly of the rear face. Advantageously, because the end of the antenna 50 is generally flush with the rear face 14 of the communications card 10, the antenna is less likely to be damaged or broken while it is in the retracted position.

Figure 2:
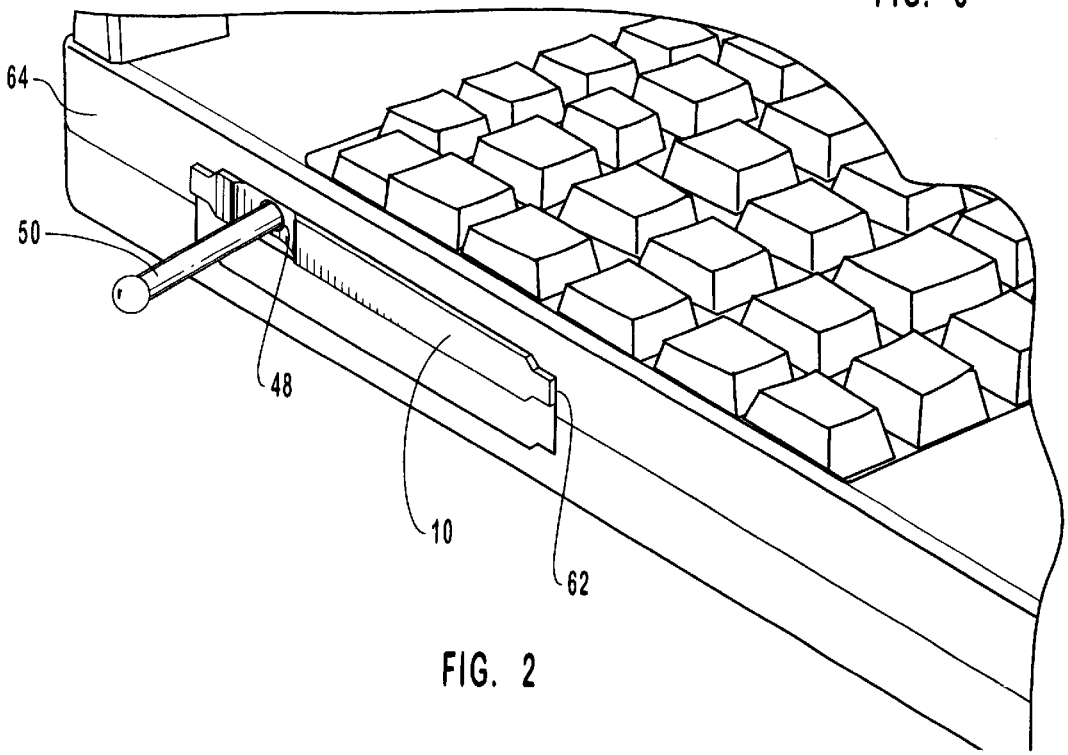
FIG. 2 is a perspective view of the communications card shown in FIG. 1, illustrating the communications card installed in a slot of a portable computer and the antenna in an extended position.

FIG. 2 illustrates the antenna 50 in an extended position and the communications card 10 inserted into a card slot 62 of a host device such as a portable computer 64. The term portable computer 64 is used broadly to describe any suitable computer such as a personal, laptop, notebook, handheld, palm or other type of computer with suitable characteristics. The antenna 50 can also be used with other electronic devices such as cellular telephones, digital communication systems, personal data assistants (PDAs), electronic organizers, GPS systems, wireless communication systems, and the like. The antenna 50 can also be used with other devices that may benefit from the ability to communicate over wireless networks such as television sets, digital telephones, automotive electronics, etc.

As discussed in more detail below, the antenna 50 is capable of receiving and transmitting signals. These signals are communicated to the communications card 10 and the communications card may include circuitry and components that process these signals. The communications card 10 may also include circuitry and components that provide electrical communication with the portable computer 64 and the computer may process these signals.

Figure 3:
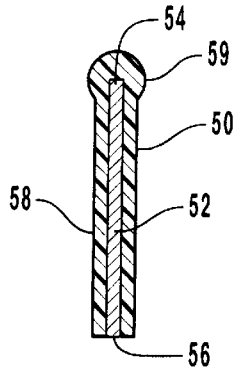
FIG. 3 is a cross sectional view side of the retractable antenna shown in FIG. 2.

A cross sectional side view of a preferred embodiment of the antenna 50 is shown in FIG. 3. The antenna 50 includes an elongated radiating element 52 that is capable of transmitting and receiving wireless signals. The radiating element 52 includes an elongated member with an outwardly extending tip 54 and a base 56 that is electrically connected to the internal circuitry of the communications card 10. The radiating element 52 is constructed from an electrically conductive material such as copper and a cover or protective sleeve 58 encases the radiating element to protect it from damage. The cover 58 may be flexible to allow the radiating element 52 to flex or it may include a strain relief section (not shown) to allow the antenna 50 to be positioned in the desired location. On the other hand, the antenna 50 may be rigid. An enlarged portion or ball 59 may be disposed at the tip 54 of the radiating element 52 to assist in the dispersion of static charges that may build up on the antenna 50. One skilled in the art will appreciate that the antenna 50 can include more than one radiating element 52, be constructed from various materials with the desired characteristics, or be any other suitable type of antenna.

The antenna 50 is preferably retractably connected to the communications card 10 or other suitable electronic device by an actuating mechanism that allows the antenna to be moved between the extended position as shown in FIG. 2 and retracted position as shown in FIG. 1. The actuating mechanism preferably allows the antenna 50 to be positioned within the housing 24 of the communications card 10 when it is not in use to protect it from damage. The actuating mechanism also allows the antenna 50 to be released from the retracted position and moved into the extended position for use.

Figures 4A, 4B, 4C:
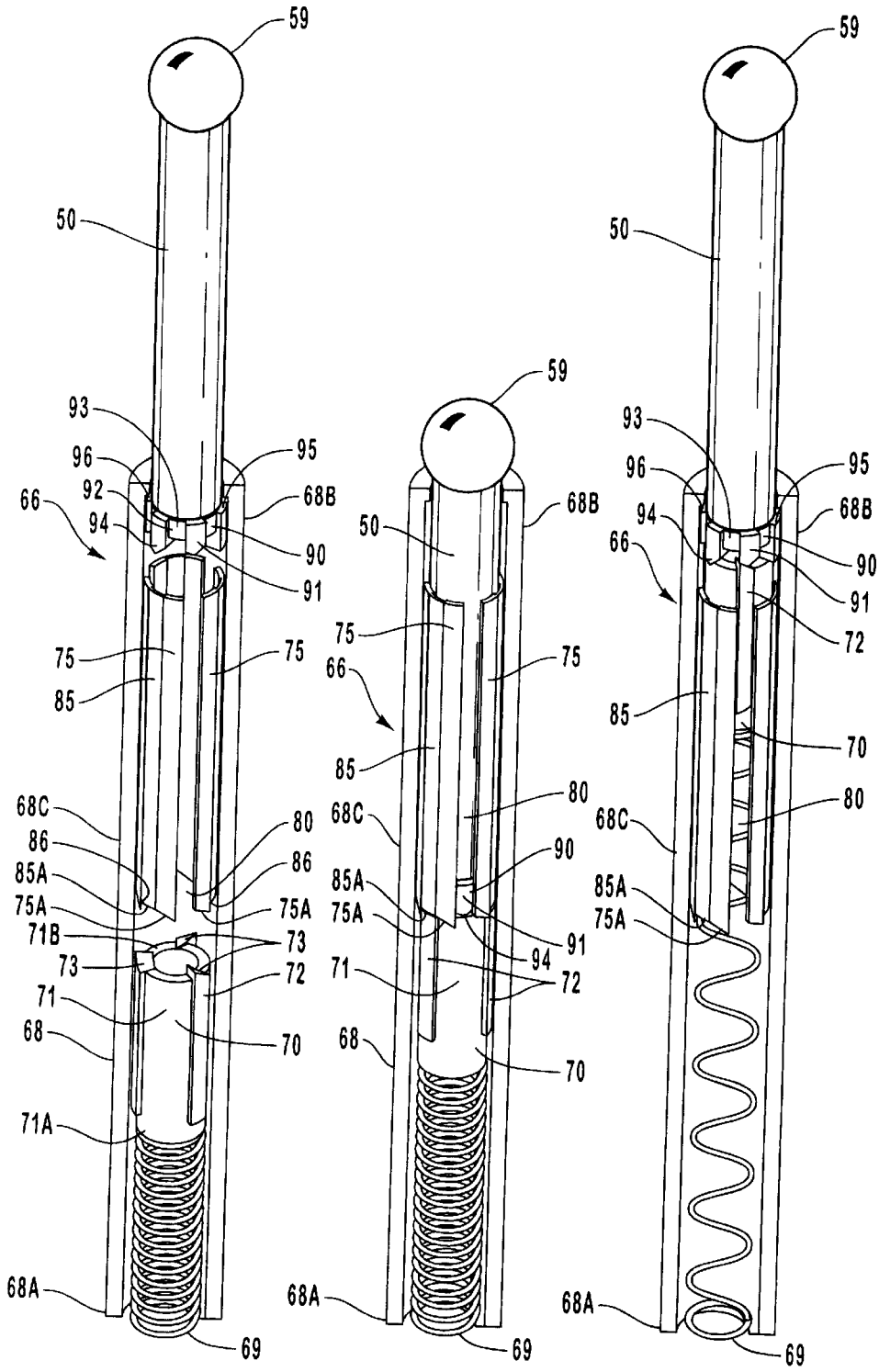
FIG. 4A is an enlarged, partially cutaway side view of a retractable antenna in accordance with another preferred embodiment of the present invention, illustrating an actuating mechanism.
FIG. 4B is a side view of the retractable antenna shown in FIG. 4A, illustrating the antenna in a retracted position.
FIG. 4C is a side view of the retractable antenna shown in FIG. 4A, illustrating the antenna in an extended position.

A preferred embodiment of an antenna actuating mechanism 66 is depicted in FIGS. 4A, B and C. FIG. 4A illustrates the various components of the actuating mechanism 66 including an elongated tube 68, a resilient member or spring 69, an antenna extender 70, guide members 75, guide channels 80, shallow guide channels 85 and a selector 90 attached to the base of the antenna 50.

In greater detail, the elongated tube 68 includes a first end 68A that is preferably disposed inside an electronic device such as the communications card 10, a second end 68B positioned proximate the rear face 14 of the communications card, and a middle portion 68C. The spring 69 is disposed in the first end 68A of the elongated tube 68 and it provides a spring force that is used to extend the antenna 50 out of the elongated tube. In particular, one end of the spring 69 contacts the antenna extender 70 and the other contacts a fixed surface such as the end of the elongated tube 68 or a portion of the communications card 10 (not shown). The antenna extender 70 includes a hollow cylindrical body 71 with a first end 71A that contacts the spring 69 and a second end 71B disposed toward the second end 68B of the elongated tube 68. The antenna extender 70 also includes a plurality of extender members 72 that are equidistantly disposed about the outer surface of the cylindrical body 71. As shown in the accompanying figures, the antenna extender 70 preferably includes three extender members 72 but it will be appreciated that it could include any suitable number of extender members. Each extender member 72 extends longitudinally along the outer surface of the cylindrical body 71 and includes an angled extender tooth 73 that extends beyond the second end 71B of the cylindrical body.

The guide members 75 are disposed on the inner surface of the elongated tube 68 and they extend along the longitudinal axis of the tube. The guide members 75 include an elongated body that extends radially inwardly from the inner surface of the elongated tube 68 and the ends of the guide members towards the first end 68A of the elongated tube 68 include angled engagement ledges 75A. The angled engagement ledges 75A are sized and configured to engage the corresponding angled extender teeth 73 of the antenna extender 70.

As best seen in FIG. 4A, there are preferably twice as many guide members 75 disposed on the inner surface of the elongate tube 68 as there are extender teeth 73 of the antenna extender 70. Additionally, the guide channels 80 and the shallow guide channels 85 are alternatingly disposed between the guide members 75 such that a guide channel 80 is disposed on one side of each guide member 75 and a shallow guide channel 85 is disposed on the other side of each guide member. Both the guide channels 80 and the shallow guide channels 85 define tracks that extend between the guide member 75 and along the longitudinal axis of the elongated tube 68, but the shallow guide channels define a slightly more shallow track because of a radially inwardly extending surface.

An angled guide channel ledge 85A is disposed on the end of each shallow guide channel 85 towards the first end 68A of the elongated tube 68. The angled guide channel ledges 85A are located adjacent to corresponding angled engagement ledges 75A of the adjacent guide members 75 and the angled ledges 75A, 85A are similarly angled such that they form a generally contiguous surface. Thus, both the guide channel ledges 85A and engagement ledges 75A are located at about the same angle and both ledges are configured to engage the angled extender teeth 73 of the antenna extender 70.

The guide member 75 on the opposing side of the shallow guide channel 85 includes an angled engagement ledge 75A that extends past the guide channel ledge 85A of the shallow guide channel 85 to form a retention notch 86. As discussed below, the retention notch 86 is configured to releasably engage the extender teeth 73 of the antenna extender 70 when the antenna 50 is in the retracted position. As seen in the accompanying figures, the three guide channels 80 and three shallow guide channels 85 are preferably disposed on the inner surface of the elongated tube 68, between the six guide members 75. One skilled in the art, however, will appreciate that the actuating mechanism 66 can include any suitable number of guide members 75, guide channels 80, shallow guide channels 85, etc. Further, the various components of the actuating mechanism 66 can have any suitable sizes and configurations depending, for example, upon the size and type of antenna 50.

As discussed below, the engagement surfaces (73, 75A and 85A), guide member 75 and channels (80 and 85) enable the selective extension and retraction of the antenna 50. Additionally, the guide channels 80 and shallow guide channels 85 preferably extend almost to the second end 68B of the elongated tube 68. It will be appreciated, however, that the channels 80 and 85 can be located in any suitable portion of the elongated tube 68 and have any suitable length.

As best seen in FIGS. 4A and 4C, the antenna actuating mechanism 66 includes a selector 90. The selector 90 includes six selector members 91 that are separated by selector grooves 92 disposed on a cylindrical body 93. As shown in the accompanying figures, the number of selector members 91 corresponds to the number of guide channels 80 and shallow guide channels 85 disposed on the inner surface of the elongated tube 68. The selector 90 includes a first end 95 that is attached to the antenna 50 and a second end disposed toward the first end 68A of the elongated tube 68. Each selector member 91 includes a selector tooth 94 that extends beyond the second end of the selector 90 and has a generally triangularly shaped configuration. The selector 90 is slidingly disposed within the elongated tube 68 with the selector members 91 disposed within guide channels 80 or the shallow guide channels 85. Thus, the six selector members 91 are slidably disposed within the guide channels 80 and shallow guide channels 85.

The antenna extender 70 and the selector 90 may be coupled by a connector pin (not shown) having one end attached to the cylindrical body 71 of the antenna extender 70 and the other end removably attached to the selector 90. The connector pin preferably allows the antenna extender 70 to axially rotate relative to the selector 90. The connector pin also enables the antenna extender 70 and the selector 90 to move longitudinally relative to one another, thus allowing a space to be created between the angled extender teeth 73 of the antenna extender 70 and the selector teeth 94 of the selector 90. As described below, this space is used during the operation of the antenna actuating mechanism 66.

In operation, the actuating mechanism 66 allows the user to selectively extend and retract the antenna 50. In the retracted position shown in FIG. 4B, the angled extender teeth 73 are disposed in the retention notches 86 created by the angled guide channel ledges 85A of the shallow guide channels 85 and the adjacent angled engagement ledges 75A of the guide member 75. The angled extender teeth 73 and retention notches 86 preferably have complimentarily angles such that the teeth are securely held within the notches. The spring force provided by the spring 69 upon the antenna extender 70 maintains each angled extender tooth 73 in the corresponding retention notch 86 to hold the antenna 50 in the retracted position. As shown in FIG. 4B, the selector 90 is positioned proximate the angled engagement ledges 75A and angled guide channel ledges 85A, and the antenna 50 is retracted within the elongated tube 68.

When it is desired to extend the antenna 50 from its retracted position to the extended position shown in FIG. 4C, the user depresses the tip or ball 59 such that the antenna 50 travels a predetermined distance into the elongated tube 68. This depressing action causes the selector teeth 94 that are disposed in the shallow guide channels 85 to contact the angled extender teeth 73 residing in the retention notches 86, which pushes the extender teeth and antenna extender 70 towards the first end 68A of the elongated tube 68. When the antenna extender 70 is pushed beyond the point where the angled extender teeth 73 are no longer held within the retention notches 86, the engagement of the slanted surfaces of the angled extender teeth and the selector teeth 94 causes the antenna extender 70 to rotate such that the angled extender teeth 73 are aligned with the adjacent angled engagement ledges 75A of the guide member 75. When the depressing force on the antenna 50 is removed, the spring force provided by the spring 69 causes the angled extender teeth 73 to slide along the angled engagement ledges 75A until the teeth enter the guide channels 80. The spring force from the spring 69 then causes the antenna extender 70 to slide within the elongated tube 68 toward the second end 68B of the elongated tube with the extender teeth 73 located in the guide channels 80. The displacement of the antenna extender 70 toward the second end 68B of the elongated tube 68 causes the antenna 50 to extend outwardly from the elongated tube 68 as shown in FIG. 4C. The extension of the antenna 50 continues until the first end 95 of the selector 90 contacts an inner lip 96 disposed at the second end 68B of the elongated tube 68. At this point, antenna extension by the antenna actuating mechanism 66 is terminated and the antenna 50 is fully extended from the elongated tube 68.

The antenna 50 can be retracted by depressing the tip or ball 59 of the antenna 50 in an axial direction such that the spring force of the spring 69 is overcome and the antenna is inserted into the elongated tube 68. During retraction of the antenna 50, the selector teeth 94 engage the angled extender teeth 73 and both the selector 90 and the antenna extender 70 are pushed towards the first end 68A of the elongated tube 68. Upon reaching the end of the guide channels 80, the engagement of the angled extender teeth 73 with the triangular surfaces of the selector teeth 94 causes the antenna extender 70 to rotate such that the angled extender teeth are now aligned with the adjacent angled engagement ledges 75A of the guide members 75. When the depressing force on the antenna 50 is removed, the spring force provided by the spring 69 causes the angled extender teeth 73 to engage and slide along the adjacent angled engagement ledges 75A until the angled extender teeth are disposed in the retention notches 86 formed by the guide channel ledges 85A of the shallow guide channels 85. At this point, the antenna 50 is again in the retracted position within the elongated tube 68 as shown in FIG. 4B. Advantageously, the antenna 50 can be easily extended and retracted by simply depressing the antenna.

Figure 5A:
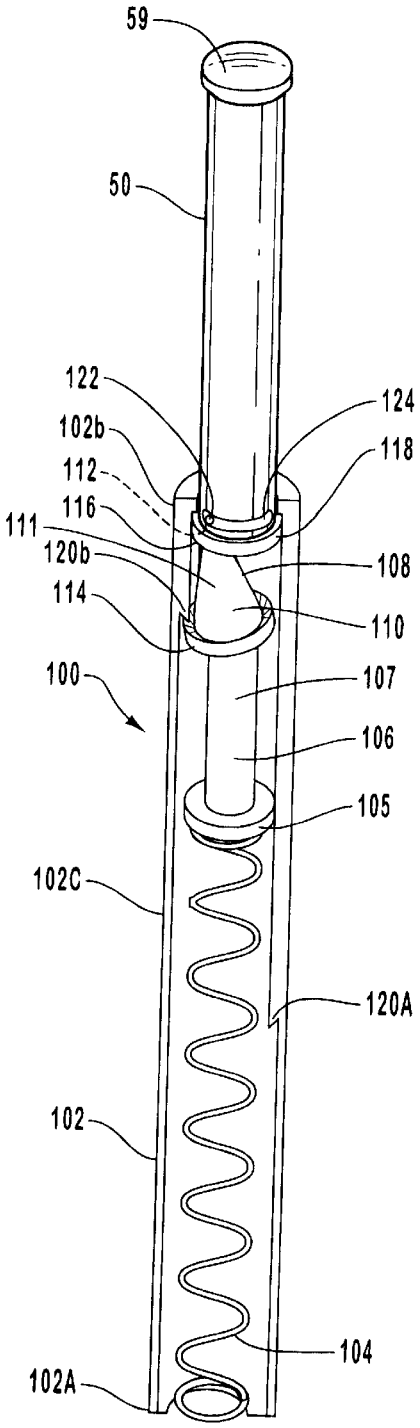
FIG. 5A is an enlarged, partially cutaway side view of a retractable antenna in accordance with another preferred embodiment of the present invention, illustrating the antenna in an extended position.
Figure 5B:
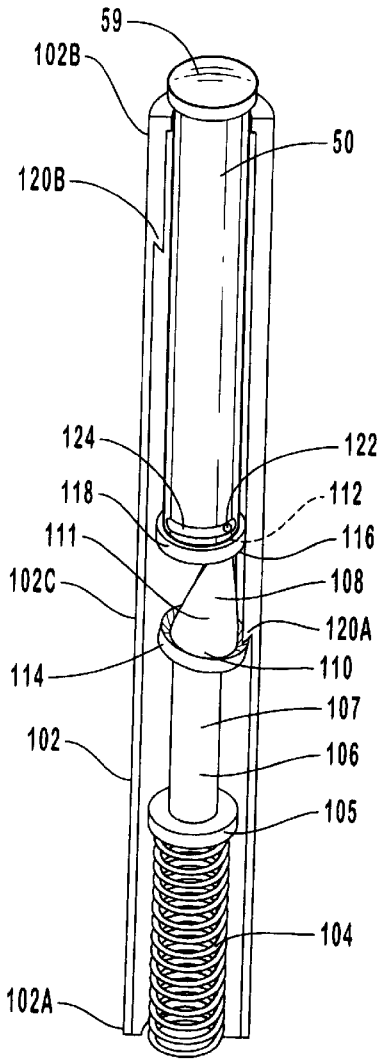
FIG. 5B is a side view of the retractable antenna shown in FIG. 5A, illustrating the antenna in a retracted position.

Another preferred embodiment for selectively extending and retracting the antenna 50 is shown in FIGS. 5A and 5B. The antenna actuating mechanism 100 includes an elongated tube 102 with a first end 102A, a second end 102B and a middle portion 102C. A spring 104 is disposed in the first end 102A of the elongated tube 102 and the first end of the spring is held in a fixed position while the second end of the spring contacts a support member 106. The support member 106 includes a base 105 that contacts the spring 104 and an elongated support shaft 107. The base 105 has an outside diameter that is slightly less than the inside diameter of the elongated tube 102 such that the support member 106 can freely move along a longitudinal axis of the elongated tube. The other end of the support shaft 107 is connected to a pivoting member 108 that includes a base 110 and a wedge 111 with an upper tip 112. The base 110 of the pivoting member 108 is pivotally connected to the shaft 107 of the support member 106 and it includes an outwardly extending flange 114. The flange 114, as discussed below, is configured to releasably engage the inwardly extending engaging members or teeth 120A, 120B to hold the antenna 50 in the extended or retracted position. The base 110 of the pivoting member 108 has an outside diameter slightly less than the inside diameter of the elongated tube 102 directly below engaging tooth 120B.

As seen in FIGS. 5A and 5B, the tip 112 of the pivoting member 108 is slidably disposed along a bottom surface 116 of a base 118 of the antenna 50. Thus, the tip 112 of the pivoting member 108 is freely slidable along the bottom surface 116 of the base 118 of the antenna. The tip 112 of the pivoting member 108 may also be attached to the base 118 of the antenna 50. For example, the tip 112 of the wedge 108 may be connected to a pin 122 disposed in a groove 124 in the base 118 of the antenna 50. The pin 122 is preferably freely slidable within the groove 124 to allow the pivoting member 108 to freely pivot within the elongated tube 102

As best seen in FIG. 5A, the actuating mechanism 100 includes two inwardly extending teeth or engaging members 120A and 120B on opposing inner surfaces of the elongated tube 102. The teeth 120A and 120B are disposed on opposite sides of the elongated tube 102 and the first tooth 120A is designed to hold the antenna 50 in the retracted position shown in FIG. 5B while the second tooth 120B is designed to hold the antenna in the extended position shown in FIG. 5A. The teeth 120A and 120B are sized and configured to engage the flange 114 of the pivoting member 108, as explained below.

The antenna actuating mechanism 100 allows the antenna 50 to be selectively extended and retracted from an electronic device, such as a communications card. In the retracted position shown in FIG. 5B, the flange 114 is engaged with the first tooth 120A. This engagement is maintained by a spring force provided by the spring 104 on the base 105 of the support member 106. This spring force, combined with the engagement of the first tooth 120A with the flange 114 on the right side of the pivoting member 108 causes the pivoting member to be angled towards the right side of the elongated tube 102. Because the support member 106 is held within the elongated tube 102, this allows the antenna 50 to be maintained in the retracted position. Additionally it, the tip 112 of the pivoting member 108 is connected to the pin 122 disposed in the groove 124 in the base 118 of the antenna 50, that positively maintains the antenna in the retracted position. One skilled in the art will appreciate that the pivoting member 108 and the antenna 50 do not have to be physically connected, and the pivoting member and antenna can be connected by any suitable means.

In order to extend the antenna 50, a user depresses the head 59 of the retracted antenna 50 such that the right side of the flange 114 is no longer engaged with the first tooth 120A. Because the spring force provided by the spring 104 is generally directed towards the center of the elongated tube and the wedge portion 111 of the pivoting member 108 is disposed towards the right side of the elongated tube, this causes the base 110 of the pivoting member to contact the left side of the elongated tube 102. Please note that the tip 112 of the wedge 111 continues to engage the right side of the base 118 of the antenna 50. Thus, when the user depresses the antenna 50 in the retracted position, the right side of the flange 114 disengages from the first tooth 120A and the left side of the flange then engages the left side of the elongated tube 102.

At this point, the user releases the head 59 of the antenna 50 and the spring 104 pushes the support member 106 and the pivoting member 108 towards the second end 102B of the elongated tube 102. The left side of the flange 114 slides along the inner surface of the elongated tube 102 until it engages the second tooth or engaging member 120B. When the left side of the flange 114 engages the second tooth 120B, the spring continues to push on the base 105 of the support member 106, which causes the pivoting member 108 to pivot about the second tooth 120B such that the wedge portion 111 moves from the right side to the left side of the elongated tube 102. As shown in FIG. 5A, the left side of the flange 114 engages the second tooth 120B and the wedge 111 of the pivoting member 108 is disposed towards the left side of the elongated tube 102. If the tip 112 of the wedge 111 is connected to the pin 122 in the base 118 of the antenna 50, the pin is also disposed on the left side of the groove 124. The antenna 50 is now in a fully extended and operable position, and is ready to transmit and receive wireless communication as desired by the user.

When wireless communication is no longer desired, the user may retract the antenna 50 for storage within the elongated tube 102. The user accomplishes this by depressing the head 59 of the antenna 50 so that the antenna begins to retract into the elongated tube 102, and this disengages the left side of the flange 114 from the second tooth 120B. Because the base 118 of the antenna 50 is pushing on the tip 112 of the pivoting member 108 that is pointed towards the left side of the elongated tube 102 and the spring force from the spring 104 is generally directed through the center of the tube, the right side of flange 114 pivots until it engages the right side of the inner surface of the tube. As the user continues to depress the antenna 50, the right side of the flange 114 slides along the right side of the inner surface of the elongated tube 102 until it slides over the first tooth 120A. Depression of the antenna 50 may be continued past this point a short distance until further insertion of the antenna 50 is prevented, such as by contact between the head 59 of the antenna 50 and the end of the elongated tube 102. At this point, the user releases the head 59 of the antenna 50, which enables the spring 104 to urge the support member 106 and the pivoting member 108 toward the second end 102B of the elongated tube 102. The right side of the flange 114 of the pivoting member 108 then engages with the first tooth 120A, and this engagement is maintained because of the spring force provided by the spring 104. The spring force, combined with the engagement of the first tooth 120A with the right side of the flange 114, causes the pivoting member 108 to pivot from the left side towards the right side of elongated tube 102. The antenna 50 is now returned to the retracted position as shown in FIG. 5B.

It should be recognized that the embodiments described above for selectively extending and retracting the antenna are preferred embodiments, but one skilled in the art will recognize that other suitable types of actuating mechanisms may be used to extend and retract the antenna. It should also be noted that the antenna could be removably attached to the actuating mechanism. This would enable removal and replacement of the antenna in the event it becomes damaged or needs replacement.

Figure 6A:
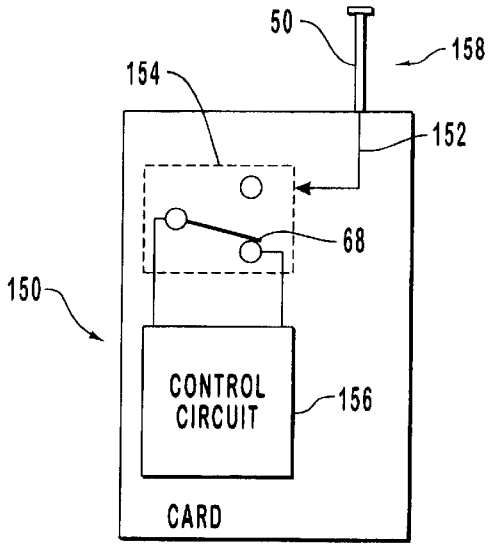
FIG. 6A is a schematic diagram of electronic circuitry used to control the operation of yet another preferred embodiment of the present invention, illustrating the antenna in the extended position.
Figure 6B:
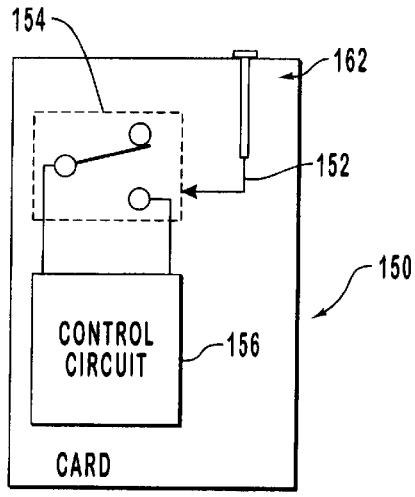
FIG. 6B is a schematic diagram of the circuitry shown in FIG. 6A, illustrating the antenna in the retracted position.

As shown in FIGS. 6A and 6B, a control switch 150 is used to control the operation of the antenna system. For example, the control switch 150 desirably prevents the antenna system from receiving or transmitting wireless information when the antenna is in the retracted position and allows wireless communication when the antenna is in the extended position. Preferably, the control switch 150 governs the operation of the antenna system automatically by controlling the flow of electrical power to the antenna or antenna system. Advantageously, the control switch 150 still allows the other features of the communications card and/or electronic device to be utilized even though the antenna is non-functional. In addition, the control switch 150 saves power and/or the batteries used to operate the communications card and/or electronic device.

As seen in the accompanying figures, the control switch 150 is preferably located in the electronic device, such as the communications card 10. The control switch 150 includes a line 152 connected to the antenna 50, a switch 154 and a control circuit 156. When the antenna 50 is located in the extended position 158, as shown in FIG. 6A, the control circuit 156 indicates the antenna 50 should be capable of transmitting and receiving wireless signals, and the control circuit 156 controls the switch 154 to allow electrical power to be supplied to the antenna. It will be appreciated that while the illustrated control circuit is used to control the supply of electrical power, it could be implemented to control other types of operational parameters as well.

FIG. 6B illustrates the antenna 50 in the retracted position 162. This position causes the control switch 150 to indicate that the antenna or antenna system should not be operable, which causes the control circuit 156 to control the switch 154 to disengage electrical power from the antenna 50. Alternatively, instead of completely turning off power to the antenna 50, an arrangement may be utilized whereby only a limited amount of power is supplied to the antenna system, but not sufficient power to allow the antenna to transmit or receive wireless communications. Also, while the illustrated embodiment in the accompanying figures contemplates actuation of the control switch 150 via the physical retraction and extension of the antenna 50, actuation could also be manually invoked by the user.

Figure 7:
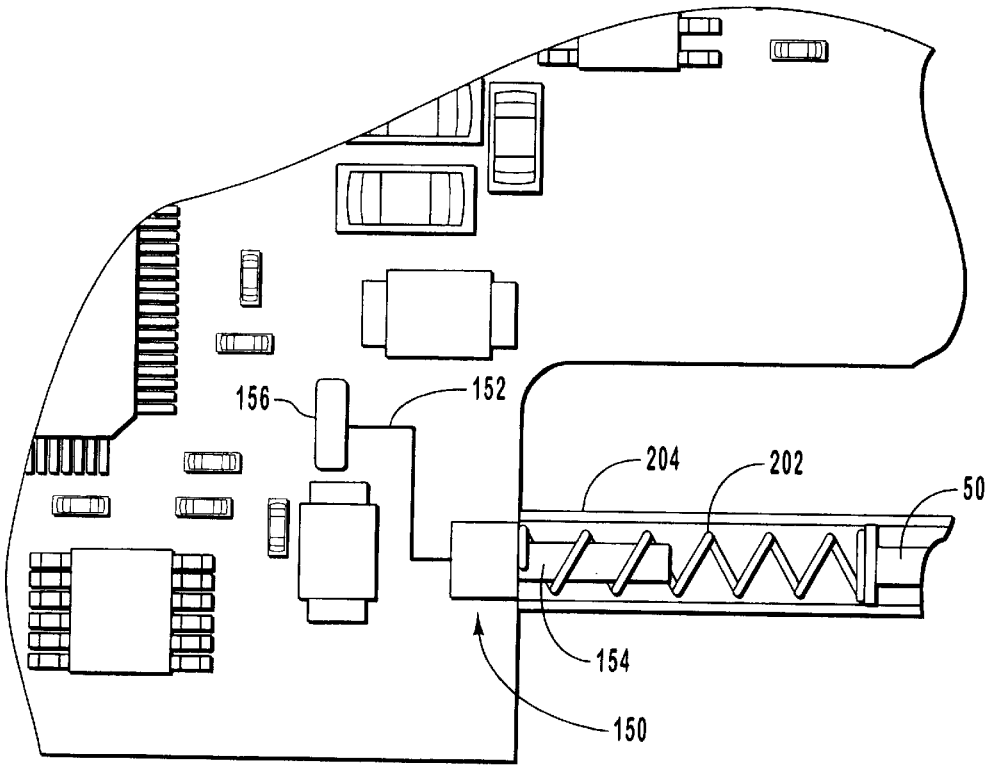
FIG. 7 is a top view of a retractable antenna in accordance with still another preferred embodiment of the present invention, illustrating a control mechanism for enabling wireless communication.

For example, as shown in FIG. 7, the base of the antenna 50 may include a spring 202 that is disposed inside an end of an elongated tube 204. The control switch 154 is located in one end of the elongated tube 204, and it is electrically connected to the control circuit 156 by the communication line 152. As seen in FIG. 7, when the antenna 50 is in its extended position, no contact is made between the base of the antenna and the control switch 154. Alternatively, when the antenna 50 is retracted into the elongated tube 204 and the spring 202 is compressed, the base of the antenna contacts the control switch 154. This indicates that the antenna 50 is in the retracted position and wireless communication should not be permitted. Thus, the control circuit 156 terminates electrical power to the antenna 50 in a manner well known in the art, thus preventing operation of the antenna while in the retracted position. One skilled in the art will appreciate that the control switch assembly described above is but one method by which power to the antenna may be selectively provided. One skilled in the art will also appreciate that other types of switches, such as toggle, leaf, or spring switches, and other suitable components, may also be used.

Figure 8:
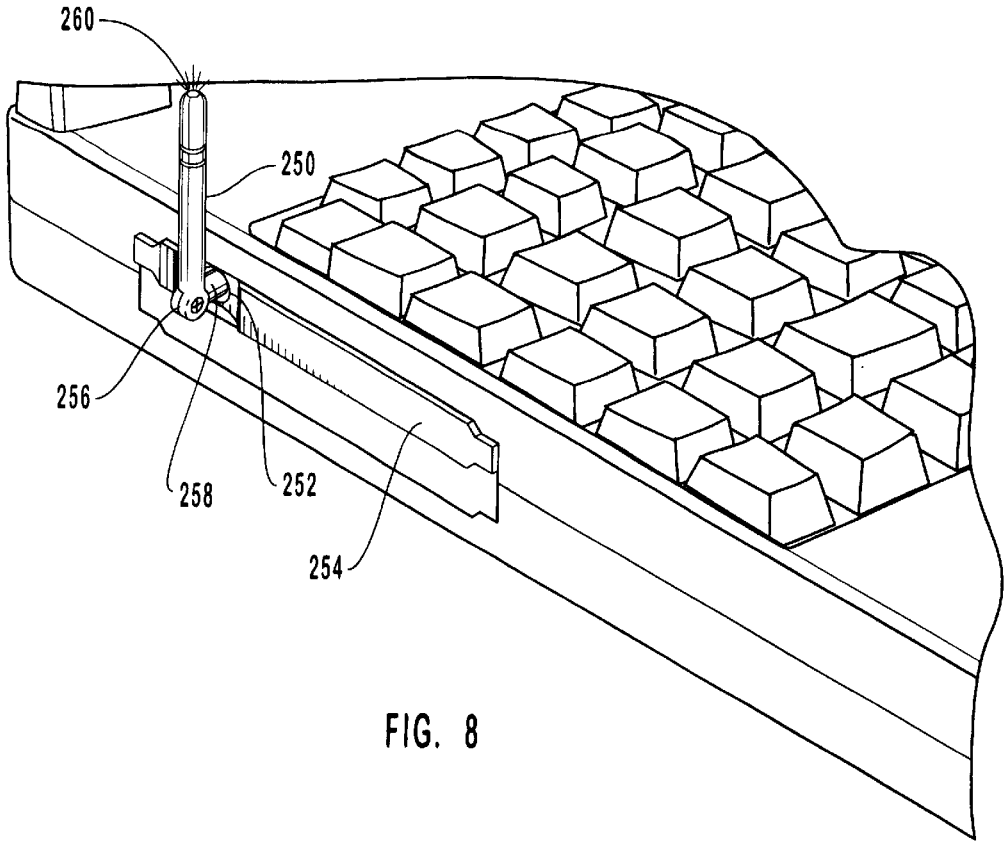
FIG. 8 is a perspective view of still another preferred embodiment of the present invention, illustrating an adjustable antenna.

FIG. 8 illustrates another preferred embodiment of the antenna system including a retractable pop-out antenna 250 extended from a cavity 252 in a communications card 254. The antenna 250 includes a joint 256, such as a knee joint (as shown) or swivel ball joint, that connects the antenna to an extender portion 258 in order to enable the extended antenna to be oriented in a variety of directions. In this way, the antenna may be positioned so as to facilitate the maximum reception and transmission quality of wireless signals. Advantageously, the antenna 250 can be retracted and extended in a similar fashion to that described above. For example, when the antenna 250 is first extended from the cavity 252, it is generally aligned with the extender portion 258 until the user reorients it for use. When wireless communication is terminated, the user realigns the antenna 250 with the extender portion 258, and the antenna 250 may then be depressed into the cavity 252.

It is also possible to include an indicator light 260 on the antenna 250, as demonstrated in FIG. 8. The light 260 may be utilized to indicate, for example, when the antenna is transmitting or receiving wireless signals, or to indicate the signal strength of the wireless communication being received. Though the indicator light as depicted in FIG. 8 is disposed on the tip of the antenna 250, it is appreciated that its location might be altered as appreciated by one of skill in the art. Also, more than one light might be used on the antenna to indicate various operation parameters.

Figure 9:
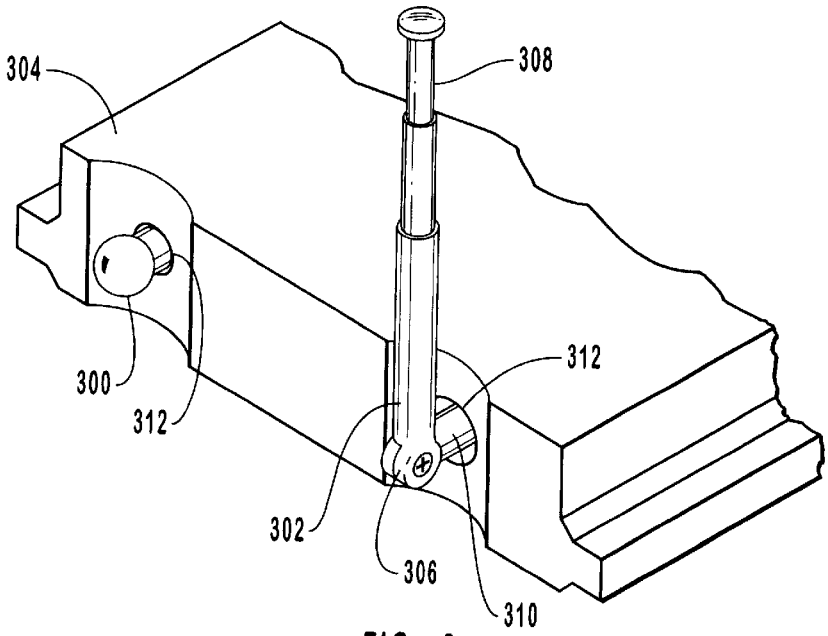
FIG. 9 is a perspective view of another preferred embodiment of the present invention, illustrating a portion of a communications card with two retractable antennas.

Another preferred embodiment of the antenna system, as shown in FIG. 9, includes a first antenna 300 and a second antenna 302 that are disposed within an electronic device, in this case a PCMCIA Type III form factor communications card 304. Such a dual antenna arrangement may be desirable when an electronic device has a need to conduct two or more wireless communication functions. Advantageously, the dual antenna arrangement may also allow simultaneous wireless communication. As shown in FIG. 9, either or both of the antennas 300, 302 may include a telescoping radiating element 308 to enhance the reception and transmission capability thereof. Desirably, the telescoping antenna 302 may be extended and retracted from the communications card in a manner similar to that described above and include one or more joints to allow the desired positioning of the antenna. Once positioned in the desired location, the antenna 302 may then be extended to maximize its transmission and reception characteristics. Once wireless communication is no longer desired, the antenna 302 is collapsed, oriented parallel with the extender portion 310, and inserted into the communications card 304.

As illustrated in the above embodiments, the antenna(s) of the present invention may comprise a variety of types and structures, e.g., rigid or flexible, single piece or telescopic, fixed or jointed, monpole or dipole. Additionally, while the embodiment above discloses the use of two retractable antennas housed within an electronic device, it is contemplated that more than two retractable antennas could be utilized within an electronic device. Indeed, the present invention may include any suitable number of antennas, with each preferably optimized for use at a specific frequency. These and other antenna arrangements are accordingly contemplated as residing within the scope of the present invention.

Figure 10:
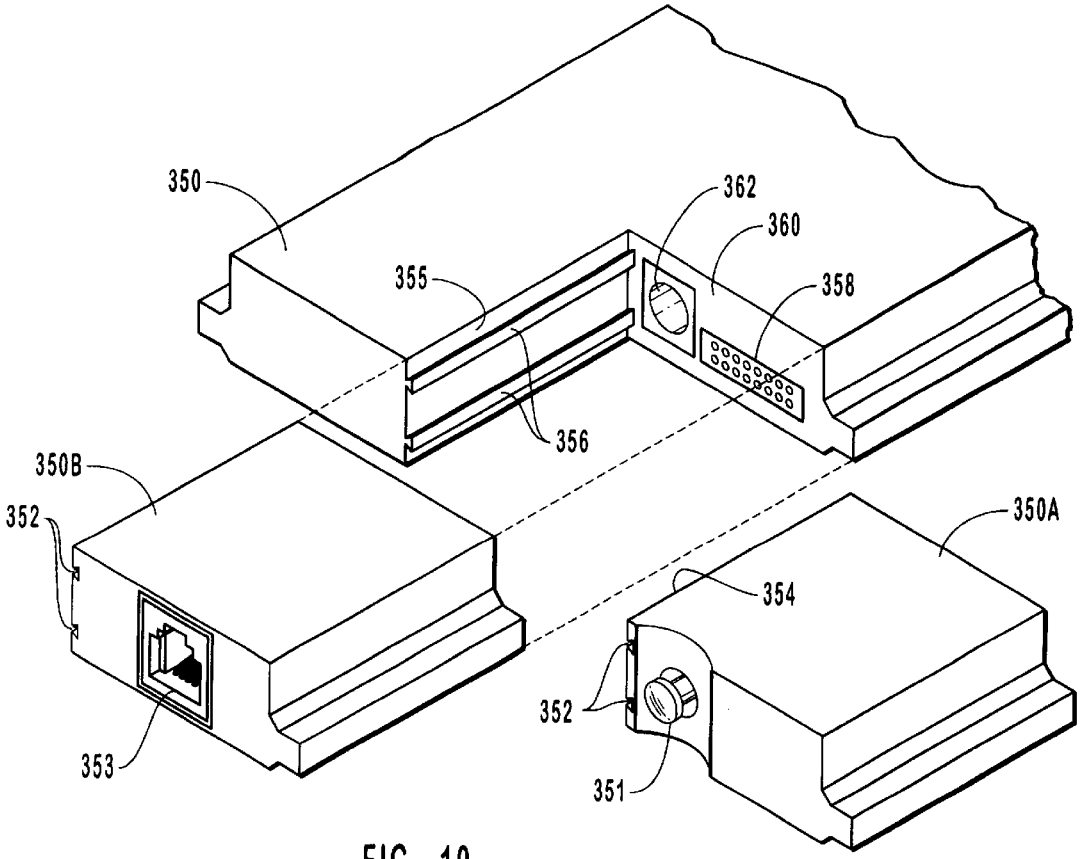
FIG. 10 is a perspective view of yet another preferred embodiment of the present invention, illustrating a portion of a communications card with a receiving portion that is configured to receive a connector or a retractable antenna.

Yet another preferred embodiment of the antenna system is illustrated in FIG. 10, which shows a PCMCIA Type III communications card 350 configured to receive a removable modular portion. The modular portion 350A has disposed in it a retractable antenna 351 in accordance with the present invention. The removable modular portion 350A is sized and configured to slidably mate with a receiving portion of the communications card 350. Channels 352, defined on an interior side 354 of the modular portion 350A, are sized and configured to slidingly receive tracks 356 disposed on a corresponding interior side 355 of the communications card 350. In this way, the modular portion 350A is slid into operable communication with the communications card 350, thus forming a complete PC card for use in a portable computer.

The modular portion 350A may include one or more electrical connectors (not shown) that are configured to electrically communicate with electrical connectors 358 disposed on an interior face 360 of the communications card 350. The connectors 358 are electrically connected to the electronics and circuitry disposed inside the communications card 350 to enable the operation of the antenna 351. The antenna 351 and the actuating mechanism used to selectively extend and retract the antenna, such as the actuating mechanism 66 or 100, are preferably both contained within the modular portion 350A. Alternatively, portions of either or both the antenna 351 and/or actuating mechanism may be received into a cavity 362 in the interior face 360 of the communications card 350. This may be desirable if the antenna 351 or the actuating mechanism is of such a size as to make it impossible for both to completely reside within the modular portion 350A. Also, while FIG. 10 depicts the modular portion 350A having a certain size and shape, it is appreciated that the modular portion 350A may comprise one of a variety of sizes and shapes. The modular portion 350A may, for example, comprise a smaller or larger portion of the communications card 350. In such cases, the communications card 350 would be correspondingly shaped so as to receive such modular portions 350A. Preferably, the modular portion 350A and communication card 350 are configured to have a generally contiguous, rectangular configuration that complies with the PCMCIA requirements for a PC Card when the modular portion is attached to the card, but it will be appreciated that the modular position and card can have any suitable size and configuration.

Also depicted in FIG. 10 is a modular portion 350B including a connector such as a TRJ series connector jack 353. The connector 353 is preferably a RJ-11 or RJ-45 series connector jack, but any suitable type of connector may be used. The modular portion 350B enables the communications card 350 to be configured so as to facilitate various functions depending on the particular connector attached to the jack 353. Though only two modular interfacing portions are illustrated and described in FIG. 10, other modular portions having differing functions could also be operated in connection with the communications card 350. The communications card 350 may include within its circuitry the necessary electronic components to enable the functioning of such other modular portions, though it is appreciated that most or all of the necessary electronics may also be disposed within the modular portion itself.

Figure 11:
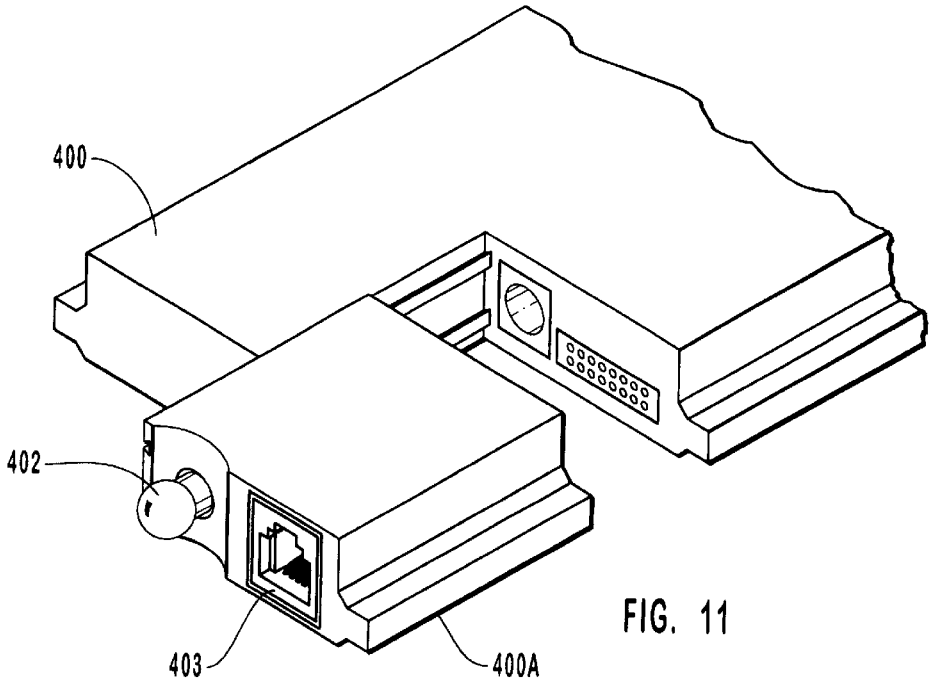
FIG. 11 is a perspective view of still another preferred embodiment of the present invention, illustrating a portion of a communications card with a receiving portion that is configured to receive a connector and a retractable antenna.

As shown in FIG. 11, a PCMCIA type III communications card 400 includes a modular portion 400A that is slidably attached to a receiving portion of the card. The modular portion 400A is preferably similar in size and configuration to the modular portion 350A and 350B of FIG. 10, but the modular portion 400A includes both a retractable antenna 402, and a connector such as a TRJ series connector jack 403. The antenna 402 preferably operates in similar fashion to the antennas described above and the electronics for the antenna and the RJ series jack 403 may be disposed in the modular portion 400A, in the communications card 400, or in both. Advantageously, this allows wireless communication via the antenna 402J, and wired communication via the RJ series jack 403. Again, it will be appreciated that other communication interfaces may be disposed on the modular portion together with the antenna 402.

Figure 12A:
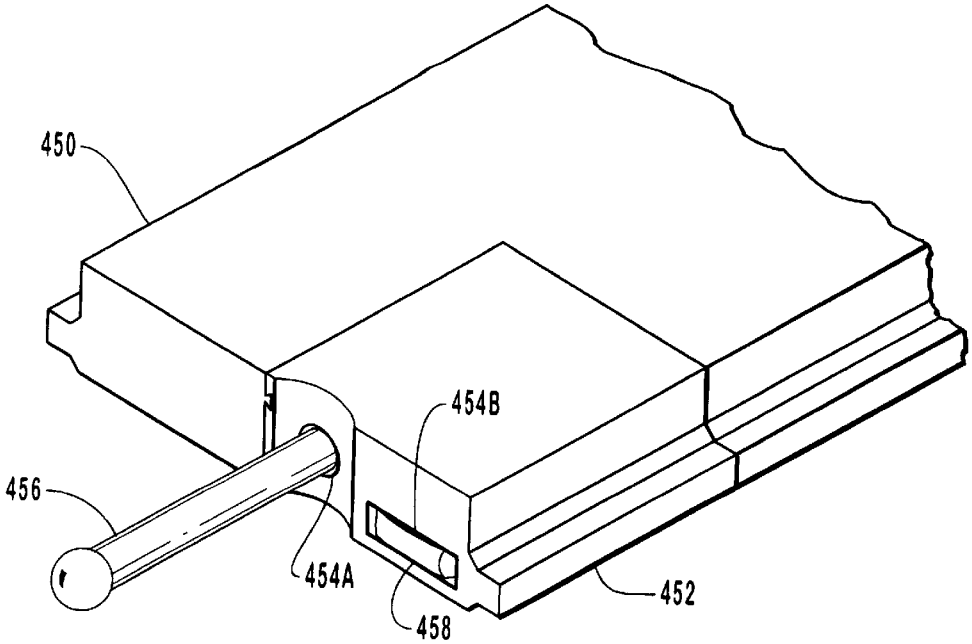
FIG. 12A is a perspective view of another preferred embodiment of the present invention, illustrating a portion of a communications card with a retractable antenna in an extended position, and a connector in a retracted position.

FIG. 12A illustrates a modified PCMCIA type III communications card 450 slidingly and electrically engaged with a modular portion 452 similar to the modular portions in 350A, 350B and 400A. The modular portion 452 includes a cavity 454A in which is disposed a retractable antenna 456. The extension, retraction, and operation of the antenna 456 is similar to those of previous embodiments, and includes a retractable connector 358 preferably disposed in a cavity 454B. The retractable connector 458 preferably includes an aperture 460 which is sited and configured to receive a connector and, more preferably, the retractable connector is an XJACK© type connector manufactured by the 3COM Corporation of Santa Clara, Calif., the assignee of the present application. The XJACK© type connector is described, for example in U.S. Pat. Nos. 5,183,404; 5,336,099; 5,338,210; 5,547,401; 5,727,972; and 5,816,832, which are hereby incorporated by reference in their entireties.

Figure 12B:
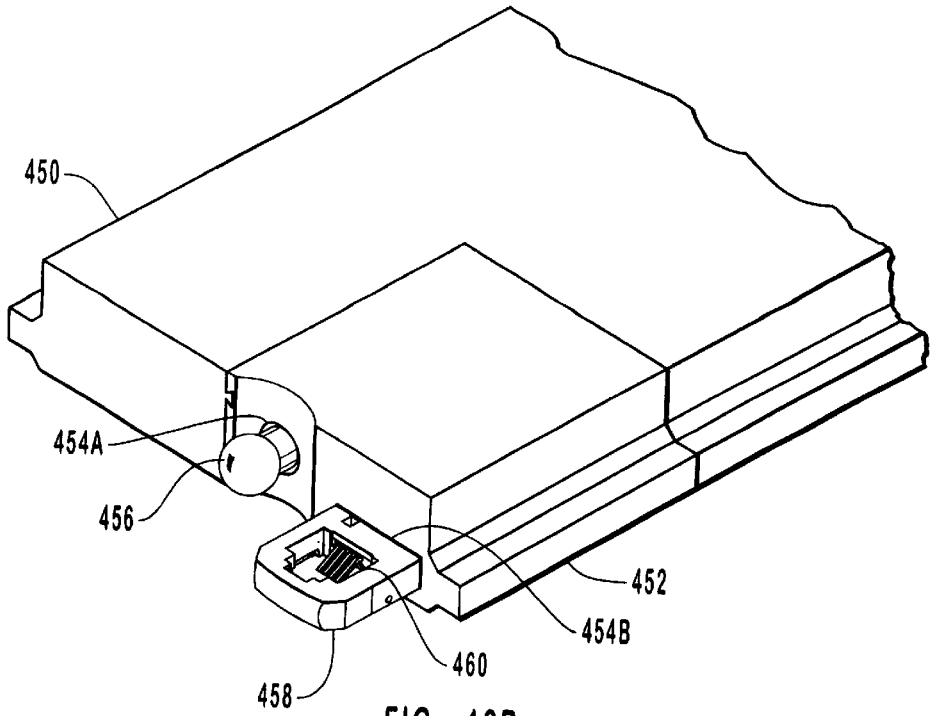
FIG. 12B is a perspective view of the communications card shown in FIG. 12A, illustrating the antenna in a retracted position and the connector in an extended position.

In FIG. 12A, the antenna 456 is extended from the communications card 450 and is ready to engage in wireless communication, while the retractable connector 458 is retracted into the cavity 454B in a stored position. In contrast, FIG. 12B depicts the retractable connector 458 in an extended position, and the antenna 456 in a retracted position within the cavity 454A. Alternatively, it is possible for both the antenna 456 and the retractable connector 458 to be disposed in extended and operable states, thus allowing the communications card 450 to engage in wireless and wired communication simultaneously. When no wired or wireless communication is desired, both the retractable connector 458 and the antenna 456 are retracted and stored in their respective cavities 454A and B within the communications card 450.

It is noted that, while FIGS. 12A and B depict the antenna and the retractable connector as residing within a modular portion of a modified communications card, the antenna and retractable connector could be directly attached to the communications card or other electronic device, which a modular portion. Further, the antennas and connectors depicted in FIGS. 10 through 12B could be directly connected to the communication cards, without requiring the use of modular portions.

Discussion of the above embodiments has been made with reference to a retractable antenna disposed within a communications card for use with portable computers. It is readily recognized, however, that the retractable antenna system disclosed herein may be advantageously employed in a variety of other stationary and mobile electronic devices including, but not limited to, personal digital assistants (PDAs), desktop computers, compact flash and other PC cards, cellular phones, GPS systems, electronic organizers, and other handheld computing devices. The present antenna system can also be used with other devices that may benefit from the ability to communicate over wireless networks such as television sets, digital telephones, and automatic electronics.

The present retractable antenna system advantageously avoids problems caused by antenna loss or breakage by retracting the antenna within the electronic device when not in use. This avoids the need for detaching and storing the antenna elsewhere when wireless communication is terminated, thus avoiding inadvertent loss thereof. The present antenna is easily extended from the electronic device and positioned for use when wireless communication is desired. It is also easily retracted when wireless communication is no longer needed. When the antenna is retracted, a control switch preferably shuts off electrical power to it, thus preventing unwanted antenna operation. Advantageously, the antenna system occupies little space within the electronic device, thus decreasing design and manufacturing costs while preserving space for other needed items in the device. If needed, the present antenna system may be configured to be removable and replaceable within the electronic device, thereby offering expanded flexibility and economy.

The present antenna system may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An antenna system comprising:

a retractable antenna including a first end and a second end; and an actuating mechanism for moving the antenna between an extended position and a retracted position, the actuating mechanism comprising:

an elongated tube at least partially disposed in an electronic device, the elongated tube including a first end and a second end, at least a portion of the antenna being configured to be stored in the tube when the antenna is in the retracted position;

a resilient member disposed in the first end of the elongated tube;

an antenna extender slidingly disposed within the elongated tube proximate the resilient member;

a selector slidingly disposed within the elongated tube, the selector including a first end attached to the antenna and a second end configured to engage the antenna extender; and a plurality of guide tracks disposed on an inner surface of the elongated tube, the guide tracks being sized and configured to guide the movement of the antenna extender and the selector through the elongated tube such that the antenna is selectably movable between the extended position and the retracted position.

2. The antenna system of claim 1, further comprising a control mechanism for automatically enabling or disabling the ability of the antenna system to engage in wireless communication.

3. The antenna system of claim 1, further comprising a joint for connecting a first portion of the antenna to a second portion of the antenna.

4. The antenna system of claim 3, wherein the joint comprises a swivel ball joint.

5. The antenna system of claim 3, wherein the joint comprises a multi-directional knee joint.

6. The antenna system of claim 1, wherein the retractable antenna comprises a telescoping antenna.

7. The antenna system of claim 1, wherein the electronic device comprises a communication card that complies with the Personal Computer Memory Card International Association ("PCMCIA") standards for a PC Card.

8. The antenna system of claim 1, further comprising an indicator attached to the antenna to provide information to a user.

9. The antenna system of claim 1, further comprising a control mechanism that permits wireless communication when the antenna is in the extended position and prohibits wireless communication when the antenna is in the retracted position.

10. The antenna system of claim 1, wherein the retractable antenna comprises multiple radiating elements.

11. The antenna system of claim 1, wherein at least a portion of the retractable antenna is flexible.

12. The antenna system of claim 1, wherein the electronic device comprises one of:

a portable computer;

a personal digital assistant;

a cellular telephone;

a palm device;

a communication card;

a compact flash card;

an electronic organizer; and, a global positioning system device.

13. The antenna system of claim 1, further comprising:

a control mechanism; and a manual control switch that cooperates with the control mechanism to enable selective operation of the antenna assembly according to the desires of a user.

14. An antenna system comprising:

a retractable antenna including a first end and a second end; and an actuating mechanism for moving the antenna between an extended position and a retracted position, the actuating mechanism comprising:

an elongated tube at least partially disposed in an electronic device, the elongated tube including a first end and a second end, at least a portion of the antenna being configured to be stored in the tube when the antenna is in the retracted position;

a resilient member disposed in the first end of the elongated tube;

a support member slidably disposed in the elongated tube proximate the resilient member;

a pivoting member slidably disposed in the elongated tube, the pivoting member including a first end configured to contact the support member and a second end that contacts the antenna;

a first flange disposed on an inner surface of the elongated tube; and a second flange disposed on the inner surface of the elongated tube;

wherein the support member is releasably connected to the first flange when the antenna is in the retracted position and the support member is releasably connected to the second flange where the antenna is in the extended position.

15. The antenna system of claim 14, wherein a tip of the pivoting member is slidingly attached to the antenna.

16. The antenna system of claim 14, further comprising a control mechanism for automatically enabling or disabling the ability of the antenna system to engage in wireless communication.

17. The antenna system of claim 14, further comprises a joint for connecting a first portion of the antenna to a second portion of the antenna.

18. The antenna system of claim 17, wherein the joint comprises a swivel ball joint.

19. The antenna system of claim 17, wherein the joint comprises a multi-directional knee joint.

20. The antenna system of claim 14, wherein the retractable antenna comprises a telescoping antenna.

21. The antenna system of claim 14, wherein the electronic device comprises a communication card that complies with the Personal Computer Memory Card International Association ("PCMCIA") standards for a VC Card.

22. The antenna system of claim 14, further comprising an indicator attached to the antenna to provide information to a user.

23. The antenna system of claim 14, further comprising a control mechanism that permits wireless communication when the antenna is in the extended position and prohibits wireless communication when the antenna is in the retracted position.

24. The antenna system of claim 14, wherein the retractable antenna comprises multiple radiating elements.

25. The antenna system of claim 14, wherein at least a portion of the retractable antenna is flexible.

26. The antenna system of claim 14, wherein the electronic device comprises one of:

a portable computer;

a personal digital assistant;

a cellular telephone;

a palm device;

a communication card;

a compact flash card;

an electronic organizer; and, a global positioning system device.

27. The antenna system of claim 14, further comprising:

a control mechanism; and a manual control switch that cooperates with the control mechanism to enable selective operation of the antenna assembly according to the desires of a user.

28. A method for selectively extending and retracting an antenna suitable for wireless communication, the method comprising the steps of:

providing a housing of an electronic device;

providing a retractable antenna that is substantially disposed inside the housing in a retracted position and substantially disposed outside the housing in an extended position;

providing an actuating mechanism that is attached to housing of the electronic device and configured to assist in moving the antenna between the extended moving the antenna between the extended position and the retracted position, wherein the actuating mechanism comprises:

an elongated tube at least partially disposed in an electronic device, the elongated tube including a first end and a second end, at least a portion of the antenna being configured to be stored in the tube when the antenna is in the retracted position;

a resilient member disposed in the first end of the elongated tube;

an antenna extender slidingly disposed within the elongated tube proximate the resilient member;

a selector slidingly disposed within the elongated tube, the selector including a first end attached to the antenna and a second end configured to engage the antenna extender; and a plurality of guide tracks disposed on an inner surface of the elongated tube, the guide tracks being sized and configured to guide the movement of the antenna extender and the selector through the elongated tube such that the antenna is selectably movable between the extended position and the retracted position;

extending the retractable antenna by depressing an end of the antenna such that the actuating mechanism moves the antenna from the retracted position to the extended position; and retracting the retractable antenna by depressing an end of the antenna such that the actuating mechanism moves the antenna from the extended position to the retracted position.

29. A method for selectively extending and retracting an antenna suitable for wireless communication, the method comprising the steps of:

providing a housing of an electronic device;

providing a retractable antenna that is substantially disposed inside the housing in a retracted position and substantially disposed outside the housing in an extended position;

providing an actuating mechanism that is attached to housing of the electronic device and configured to assist in moving the antenna between the extended moving the antenna between the extended position and the retracted position, wherein the actuating mechanism comprises:

an elongated tube at least partially disposed in an electronic device, the elongated tube including a first end and a second end, at least a portion of the antenna being configured to be stored in the tube when the antenna is in the retracted position;

a resilient member disposed in the first end of the elongated tube;

a support member slidably disposed in the elongated tube proximate the resilient member;

a pivoting member slidably disposed in the elongated tube, the pivoting member including a first end that contacts the support member and a second end that contacts the antenna;

a first flange disposed on an inner surface of the elongated tube; and a second flange disposed on the inner surface of the elongated tube;

wherein the support member is releasably connected to the first flange when the antenna is in the retracted position and the support member is releasably connected to the second flange where the antenna is in the extended position;

extending the retractable antenna by depressing an end of the antenna such that the actuating mechanism moves the antenna from the retracted position to the extended position; and retracting the retractable antenna by depressing an end of the antenna such that the actuating mechanism moves the antenna from the extended position to the retracted position.

30. An electronic device capable of wireless communication, the electronic device comprising:

a communications card including a housing and a printed circuit board at least partially disposed within the housing;

a receiving portion disposed in the communications card; and a modular portion sized and configured to be removably attached to the receiving portion of the communications card, the modular portion including a retractable antenna with a first end and a second end, the modular portion including at least a portion of:

a retractable antenna including a first end and a second end; and an actuating mechanism for moving the antenna between an extended position and a retracted position, the actuating mechanism comprising:

an elongated tube at least partially disposed in an electronic device, the elongated tube including a first end and a second end, at least a portion of the antenna being configured to be stored in the tube when the antenna is in the retracted position;

a resilient member disposed in the first end of the elongated tube;

an antenna extender slidingly disposed within the elongated tube proximate the resilient member;

a selector slidingly disposed within the elongated tube, the selector including a first end attached to the antenna and a second end configured to engage the antenna extender; and a plurality of guide tracks disposed on an inner surface of the elongated tube, the guide tracks being sized and configured to guide the movement of the antenna extender and the selector through the elongated tube such that the antenna is selectably movable between the extended position and the retracted position.

31. The electronic device of claim 30, further comprising a control mechanism for automatically enabling or disabling the retractable antenna to engage in wireless communication.

32. The electronic device of claim 30, further comprising a RJ series connector jack attached to the modular portion.

33. The electronic device of claim 30, further comprising a second modular portion, the second modular portion including a RJ series connector jack.

34. The electronic device of claim 30, further comprising a retractable access portion attached to the modular portion, the retractable access portion defining an aperture sized and shaped to be capable of receiving a physical/electrical media connector.

35. The electronic device of claim 30, further comprising a control mechanism that permits wireless communication when the antenna is in the extended position and prevents wireless communication when the antenna is in the retracted position.

36. An electronic device capable of wireless communication, the electronic device comprising:

a communications card including a housing and a printed circuit board at least partially disposed within the housing;

a receiving portion disposed in the communications card; and a modular portion sized and configured to be removably attached to the receiving portion of the communications card, the modular portion including a retractable antenna including a first end and a second end, the modular connector including at least a portion of:

an actuating mechanism for moving the antenna between an extended position and a retracted position, the actuating mechanism comprising:

an elongated tube at least partially disposed in an electronic device, the elongated tube including a first end and a second end, at least a portion of the antenna being configured to be stored in the tube when the antenna is in the retracted position;

a resilient member disposed in the first end of the elongated tube;

a support member slidably disposed in the elongated tube proximate the resilient member;

a pivoting member slidably disposed in the elongated tube, the pivoting member including a first end that contacts the support member and a second end that contacts the antenna;

a first flange disposed on an inner surface of the elongated tube; and a second flange disposed on the inner surface of the elongated tube;

wherein the support member is releasably connected to the first flange when the antenna is in the retracted position and the support member is releasably connected to the second flange where the antenna is in the extended position.

37. The electronic device of claim 36, further comprising a control mechanism for automatically enabling or disabling the retractable antenna to engage in wireless communication.

38. The electronic device of claim 36, further comprising a RJ series connector jack attached to the modular portion.

39. The electronic device of claim 36, further comprising a second modular portion, the second modular portion including a RJ series connector jack.

40. An electronic device capable of wireless communication, the electronic device comprising:

a housing;

a printed circuit board substantially disposed within the housing and including electronic circuitry; and an antenna system, the antenna system being configured for communication with at least some of the electronic circuitry and comprising:

a retractable antenna including a first end and a second end; and an actuating mechanism for moving the antenna between an extended position and a retracted position, the actuating mechanism comprising:

an elongated tube at least partially disposed in the housing, the elongated tube including a first end and a second end, at least a portion of the antenna being configured to be stored in the tube when the antenna is in the retracted position;

a resilient member disposed in the first end of the elongated tube;

an antenna extender slidingly disposed within the elongated tube proximate the resilient member;

a selector slidingly disposed within the elongated tube, the selector including a first end attached to the antenna and a second end configured to engage the antenna extender; and a plurality of guide tracks disposed on an inner surface of the elongated tube, the guide tracks being sized and configured to guide the movement of the antenna extender and the selector through the elongated tube such that the antenna is selectably movable between the extended position and the retracted position.

41. The electronic device as recited in claim 40, further comprising a control mechanism for automatically enabling or disabling the ability of the antenna system to engage in wireless communication.

42. The electronic device as recited in claim 40, further comprising a joint for connecting a first portion of the antenna to a second portion of the antenna.

43. The electronic device as recited in claim 40, further comprising a control mechanism that permits wireless communication when the antenna is in the extended position and prevents wireless communication when the antenna is in the retracted position.

44. An electronic device capable of wireless communication, the electronic device comprising:

a housing;

a printed circuit board substantially disposed within the housing and including electronic circuitry; and an antenna system, the antenna system being configured for communication with at least some of the electronic circuitry and comprising:

a retractable antenna including a first end and a second end; and an actuating mechanism for moving the antenna between an extended position and a retracted position, the actuating mechanism comprising:

an elongated tube at least partially disposed in the housing, the elongated tube including a first end and a second end, at least a portion of the antenna being configured to be stored in the tube when the antenna is in the retracted position;

a resilient member disposed in the first end of the elongated tube;

a support member slidably disposed in the elongated tube proximate the resilient member;

a pivoting member slidably disposed in the elongated tube, the pivoting member including a first end configured to contact the support member and a second end that contacts the antenna;

a first flange disposed on an inner surface of the elongated tube; and a second flange disposed on the inner surface of the elongated tube;

wherein the support member is releasably connected to the first flange when the antenna is in the retracted position and the support member is releasably connected to the second flange where the antenna is in the extended position.

45. The electronic device as recited in claim 44, The antenna system of claim 14, wherein a tip of the pivoting member is slidingly attached to the antenna.

46. The electronic device as recited in claim 44, further comprising a control mechanism for automatically enabling or disabling the ability of the antenna system to engage in wireless communication.

47. The electronic device as recited in claim 44, further comprising a joint for connecting a first portion of the antenna to a second portion of the antenna.

48. The electronic device as recited in claim 44, further comprising a control mechanism that permits wireless communication when the antenna is in the extended position and prevents wireless communication when the antenna is in the retracted position.

* * * * *